US009476210B2

(12) United States Patent
Urzelai Ezkibel et al.

(10) Patent No.: US 9,476,210 B2
(45) Date of Patent: Oct. 25, 2016

(54) SELF-CLIMBING SCAFFOLD SYSTEM IN CONSTRUCTION WORKS OF BUILDINGS AND SELF-CLIMBING METHOD

(71) Applicant: ULMA C y E, S. Coop, Oñati (ES)

(72) Inventors: Liborio Urzelai Ezkibel, Oñati (ES); Ander Egaña Urrutia, Oñati (ES)

(73) Assignee: ULMA CYE, S. COOP, Oñati (ES)

( * ) Notice: Subject to any disclaimer, the term of this patent is extended or adjusted under 35 U.S.C. 154(b) by 0 days.

(21) Appl. No.: 14/538,567

(22) Filed: Nov. 11, 2014

(65) Prior Publication Data

US 2015/0129359 A1 May 14, 2015

(30) Foreign Application Priority Data

Nov. 12, 2013 (EP) ..... 13382457

(51) Int. Cl.
*E04G 11/28* (2006.01)
*E04G 3/28* (2006.01)
(Continued)

(52) U.S. Cl.
CPC . *E04G 3/28* (2013.01); *E04G 3/20* (2013.01); *E04G 5/04* (2013.01); *E04G 11/28* (2013.01); *E04G 2003/286* (2013.01)

(58) Field of Classification Search
CPC ... E04G 11/28; E04G 21/32; E04G 21/3219; E04G 21/3261; E04G 21/3247; E04G 3/20; E04G 3/28; E04G 2003/286; E04G 11/32; E04G 11/20; E04G 11/06; E04G 2011/067; E04G 5/046; E04G 5/062; E04G 2005/068
See application file for complete search history.

(56) References Cited

U.S. PATENT DOCUMENTS 2,118,374 A * 5/1938 Doyle ..... E04G 11/22 182/82
3,591,123 A * 7/1971 Edwards ..... E04G 11/28 249/10

(Continued)

FOREIGN PATENT DOCUMENTS

AT DE 102007018851 A1 * 10/2008 ..... E04G 11/28
CA 2613171 A1 1/2007

(Continued)

OTHER PUBLICATIONS

European extended search report for EP Application No. 13382457.3, European Patent Office, mail date Mar. 27, 2014, p. 1-5, Munich Germany.

*Primary Examiner* — Daniel Cahn
(74) *Attorney, Agent, or Firm* — Edell, Shapiro & Finnan LLC

(57) ABSTRACT

A self-climbing scaffold system that includes rails and shoes fixed to concrete sections of a building that are adapted for guiding the rail in a climbing direction Z. The system further includes a guide element pivotally coupled to the rail, the guide element having at least a first guide surface which, in a prior position before a threading position for threading the rail, projects with respect to the rail towards a corresponding concrete section. The first guide surface is adapted for interfacing with the shoe in said prior position and straightening the rail with respect to the shoe as said first guide surface moves in a guided manner in the shoe pivoting with respect to the rail.

7 Claims, 10 Drawing Sheets

(51) Int. Cl.
*E04G 5/04* (2006.01)
*E04G 3/20* (2006.01)

(56) References Cited

U.S. PATENT DOCUMENTS

| | | | | | |
|---|---|---|---|---|---|
| 3,606,237 | A * | 9/1971 | Stephens | E04G 11/28 | 249/189 |
| 4,060,358 | A * | 11/1977 | Fougea | E04G 11/28 | 182/128 |
| 4,540,150 | A * | 9/1985 | Tzincoca | E04G 11/28 | 249/20 |
| 4,611,784 | A * | 9/1986 | Gallis | E04G 5/04 | 182/82 |
| 4,671,382 | A * | 6/1987 | D'Alessio | E04G 1/36 | 182/128 |
| 4,838,382 | A * | 6/1989 | Nusbaum | E04G 21/3261 | 182/138 |
| 5,000,287 | A * | 3/1991 | Schwo/ rer | E04G 11/28 | 182/136 |
| 8,673,189 | B2 | 3/2014 | Schwoerer | | |
| 2003/0052249 | A1* | 3/2003 | Waldschmitt | E04G 11/28 | 249/20 |
| 2008/0224022 | A1* | 9/2008 | Kreiner | E04G 11/22 | 249/192 |
| 2009/0173574 | A1* | 7/2009 | Hobmeier | E04G 11/28 | 182/82 |
| 2010/0038518 | A1* | 2/2010 | Schwoerer | E04G 11/28 | 249/20 |
| 2011/0171336 | A1* | 7/2011 | Schwoerer | E04G 11/28 | 425/63 |
| 2011/0214824 | A1* | 9/2011 | Beristain | E04G 21/16 | 160/368.1 |
| 2013/0318888 | A1 | 12/2013 | Schwoerer | | |
| 2016/0040441 | A1* | 2/2016 | Dingler | E04G 3/28 | 248/241 |

FOREIGN PATENT DOCUMENTS

| | | | | | |
|---|---|---|---|---|---|
| DE | 2402683 | A1 | 7/1975 | | |
| DE | WO 2007000139 | A1 * | 1/2007 | E04G 11/28 | |
| EP | 2365159 | A1 | 9/2011 | | |
| WO | WO2007000139 | A1 | 1/2007 | | |
| WO | WO2009117986 | A1 | 10/2009 | | |
| WO | WO 2009117986 | A1 * | 10/2009 | E04G 11/28 | |

* cited by examiner

SELF-CLIMBING SCAFFOLD SYSTEM IN CONSTRUCTION WORKS OF BUILDINGS AND SELF-CLIMBING METHOD

CROSS-REFERENCE TO RELATED APPLICATIONS

This application relates to and claims the benefit and priority to European Application No. EP13382457.3, filed Nov. 12, 2013.

TECHNICAL FIELD

The present invention is related to a self-climbing scaffold system in construction works of buildings.

BACKGROUND

Self-climbing scaffold systems in construction works of buildings such as those described in EP2365159A1 are known, wherein the self-climbing system comprises rails arranged parallel to one another, shoes anchored to a concrete section of the corresponding building and adapted for guiding the rail in a climbing direction, and at least one work platform supported by the rails, comprising at least one substantially horizontal guide and an outer formwork movable along the guide. These self-climbing systems comprise drive means moving the rails in the climbing direction to allow building new concrete sections.

CA02613171A describes a self-climbing system wherein the rails forming the self-climbing system are attached to one another by means of pivotable attachments, the relative position between two rails that are coupled to one another being adjusted by adjustment means whereby the operator can correct the trajectory of both rails.

SUMMARY OF THE DISCLOSURE

According to some implementations a self-climbing scaffold system is provided that comprises at least one rail, at least one shoe anchored to a concrete section of the building and adapted for guiding the rail in a climbing direction, and at least one work platform supported by the rail, comprising at least one substantially horizontal guide and an outer formwork movable along the guide.

The self-climbing system further comprises a guide element adapted for being coupled to the rail in a pivotable manner with respect to an axis of rotation. According to some implementations the guide element comprises at least a first guide surface projecting with respect to the rail towards the concrete section, in a prior position before a threading position for threading the rail in the corresponding shoe, said first guide surface being adapted for contacting with the shoe and straightening the rail with respect to the corresponding shoe as said first surface moves guided by the shoe. A self-climbing system is thus obtained which provides a simple way of threading the rail in a shoe arranged at a higher level regardless of whether the rail was bent due to the weight of the work platform, being separated from the concrete section of the building or of whether, in contrast, the shoes are not substantially arranged in vertical alignment (for example when the concrete sections have setbacks), preventing in both cases the operator from having to make too much effort to straighten the rail and to try to thread it in the corresponding shoe.

These and other advantages and features of the will become evident in view of the drawings and the detailed description of the invention.

DETAILED DISCLOSURE OF THE INVENTION

Figure 1:
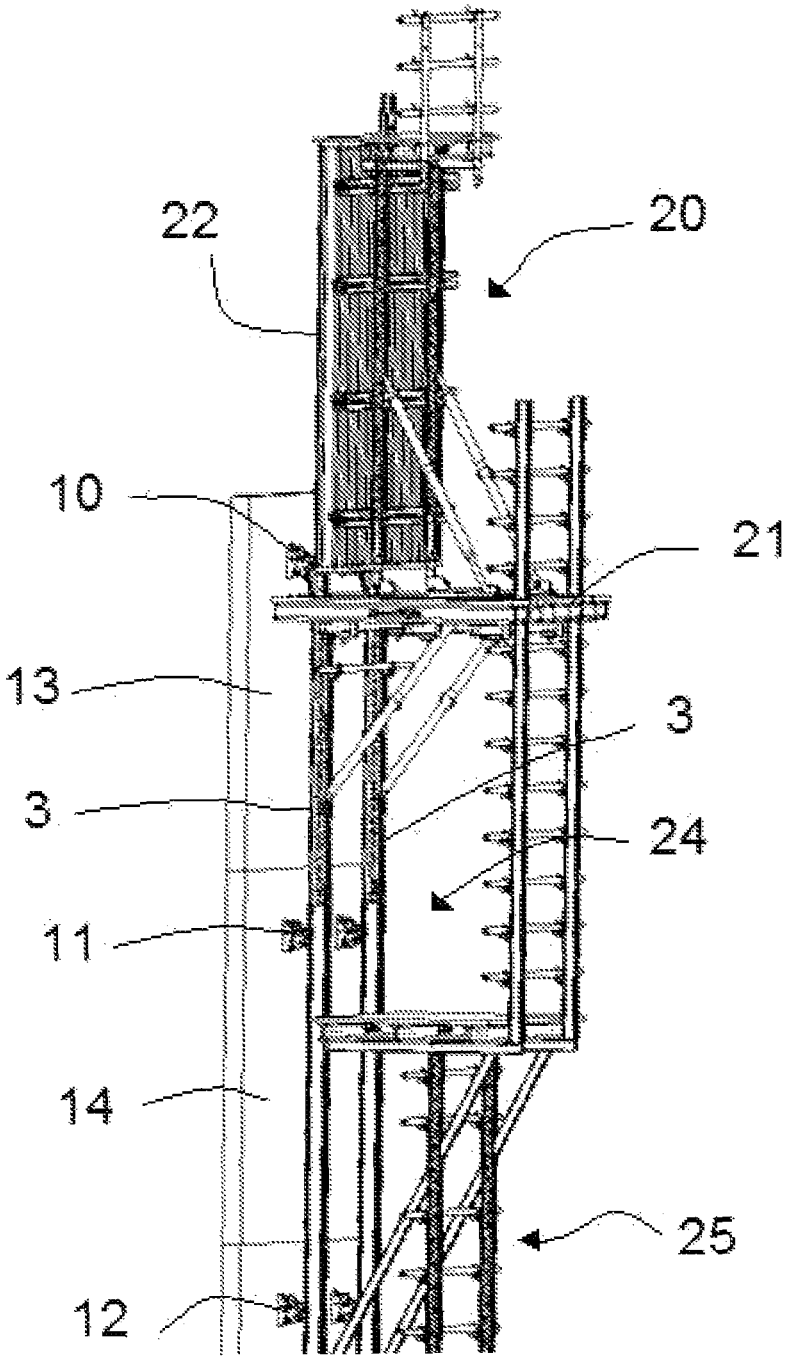
FIG. 1 shows a perspective view of a self-climbing system according to one implementation.

According to some implementations a self-climbing scaffold system 1 is provided that comprises at least one rail 3, at least one shoe 10, 11 and 12 fixed to the concrete of the building through anchoring means 4 and adapted for guiding the rail 3 in a climbing direction Z, and at least one work platform 20 supported by the rail 3 and comprising at least one substantially horizontal guide 21, and an outer formwork 22 movable along said guide 21.

Figure 2:
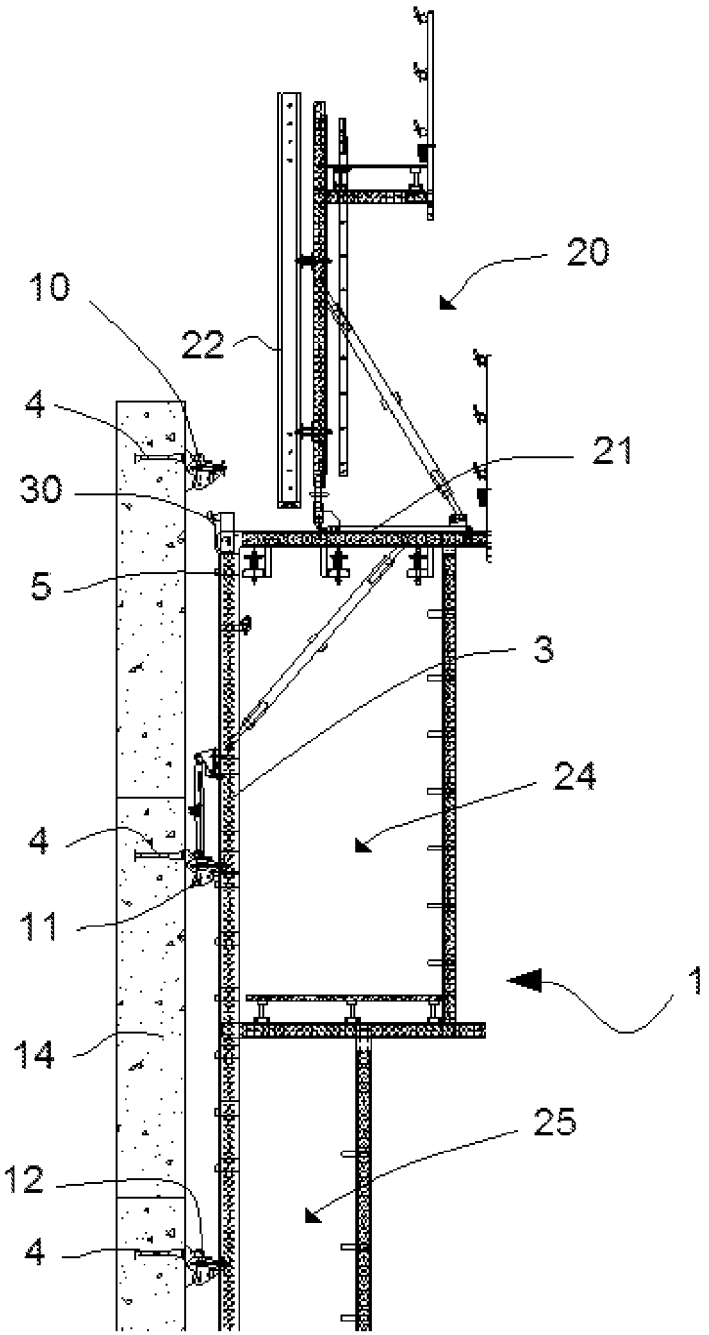
FIG. 2 shows a side view of the self-climbing system shown in FIG. 1.

FIGS. 1 and 2 show an implementation of the self-climbing scaffold system 1 comprising the shoes 10, 11 and 12 each of them anchored to the corresponding previously built concrete section 13, 14 and 15, and two rails 3 arranged substantially parallel to one another, each of which is supported and guided simultaneously by at least two shoes 11 and 12 arranged substantially in alignment with one another.

According to some implementations the work platform 20 is supported by the rails 3 through at least two guides 21 arranged substantially parallel to one another. The guides 21 are substantially horizontal. The outer formwork 22 is arranged coupled to each guide 21 through coupling means which allow the outer formwork 22 to move in a guided manner along the guides 21 so that the operator can move it closer to the concrete sections 13, 14 and 15 built for formworking a new concrete section. The coupling means for coupling the outer formwork 22 to the guides 21 are known in the state of the art, and since they are not object of the invention, it is not considered necessary to describe them in further detail in the description.

The self-climbing system 1 can further comprise other auxiliary work platforms 24 and 25, shown in FIGS. 1 and 2, arranged substantially parallel to the work platform 20 at lower levels, for allowing operators to work simultaneously on the corresponding concrete sections 14 and 15 at different levels.

Each rail 3 and each guide 21 may be formed by at least one section having a substantially H-shaped cross-section. Each H-shaped section may then be in turn formed by two sections having a substantially C-shaped cross-section fixed to one another. Each C-shaped section may comprise a plurality of holes and/or slots that enable fixing the two C-shaped sections to one another for forming the H-shaped section. Said holes and/or slots furthermore allow fixing two or more rails 3 to one another to obtain the necessary length in each case and/or to fix other structures (for example the guides 21) to the rails 3 by means of standard fixings. Each rail 3 further comprises known supporting elements 5 (one of them being depicted in FIGS. 2, 3, 5, 7 and 8), arranged between the two C-shaped sections forming the corresponding H-shaped section, and extending towards the anchors 4 of the shoes 10, 11 and 12, cooperating with the shoes 10, 11 and 12 in the support (shown in FIG. 7) and in the climbing of the self-climbing system 1. Each guide 21 is attached to the corresponding rail 3 through a connecting element 44. The connecting element 44 has a substantially L-shaped geometry.

Each shoe 10, 11 and 12, the features of which are described in detail in EP2365159A1, which is incorporated by reference in its entirety herein, comprises two claws 17 and 18 that are pivotally coupled to one another through a bolt 19. When the claws 17 and 18 are closed, in the position shown in FIGS. 4 and 9, they demarcate a housing 27 through which the rail 3 moves in the climbing direction Z. In the closed claw position, the claws 17 and 18 surround the rail 3, particularly a flange of the rail 3, guiding the movement of the rail 3. Each shoe 10, 11 and 12 further comprises a rocker 28 pivotable with respect to an axis of rotation substantially orthogonal to the pivoting axis of the claws 17 and 18. The rocker 28 is adapted for pivoting between a working position (shown in FIG. 7), in which said rocker 28 supports the supporting element 5 of the corresponding rail 3, and a climbing position (shown in FIGS. 3, 5, 6 and 8), in which the rocker 28 allows the movement of the rail 3 in the climbing direction Z.

In order for the self-climbing scaffold system 1 to climb for building new concrete sections, the rails 3 move in the climbing direction Z and thread the next shoe 10, i.e., they thread the free shoe 10 arranged immediately there above. The self-climbing system comprises means causing the movement of said rails 3, the details of which are not included given that they are not object of the invention and it is not considered necessary for understanding same.

Figure 7:
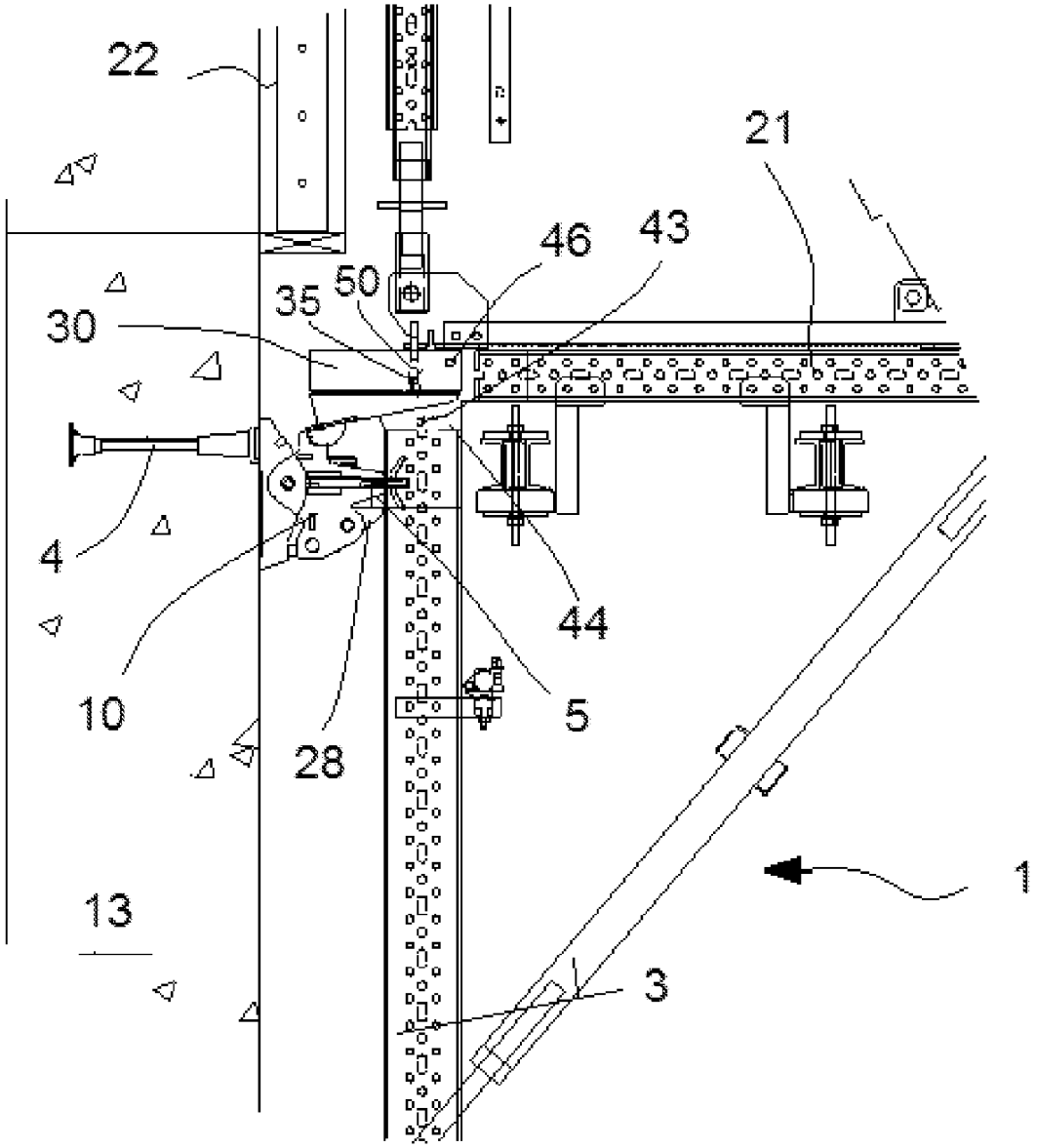
FIG. 7 shows a partial side view of the self-climbing system shown in FIG. 1 once threaded, with a guide element arranged in a horizontal working position.
Figure 8:
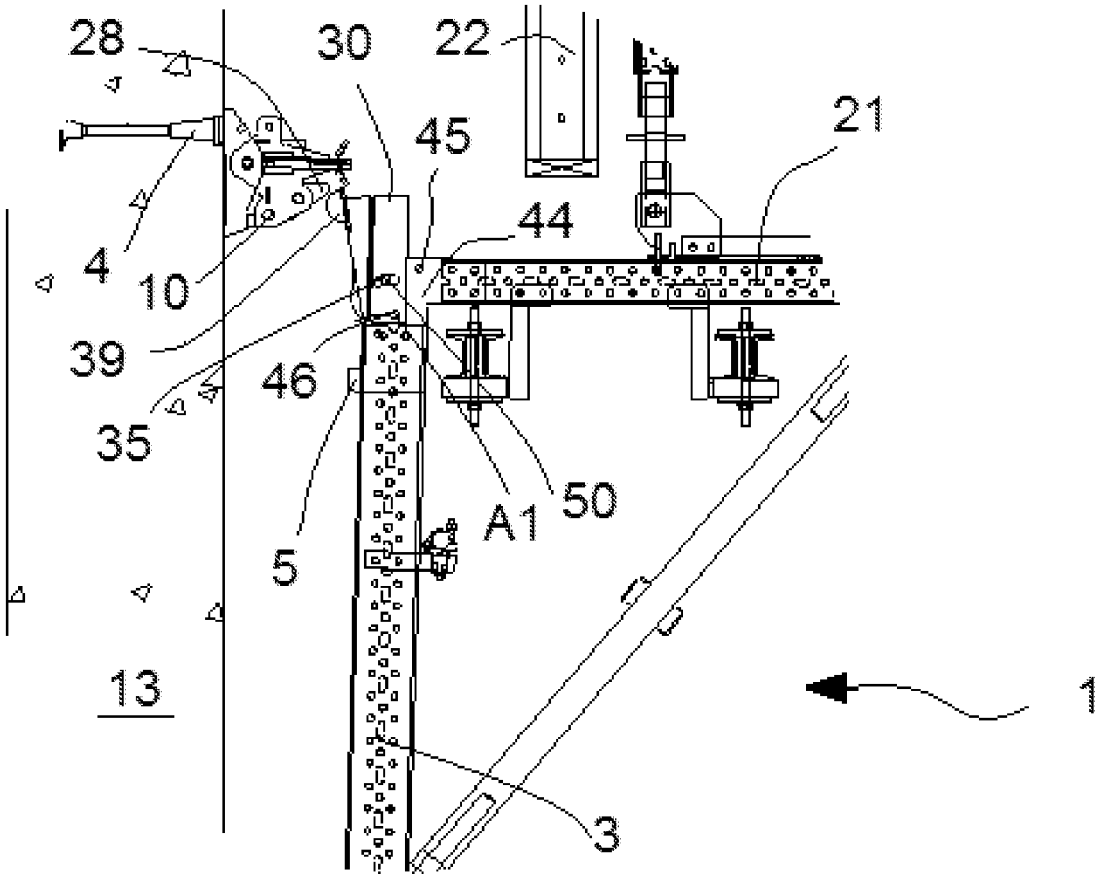
FIG. 8 shows a partial side view of the self-climbing system shown in FIG. 1, in another position prior to the threading position.
Figure 9:
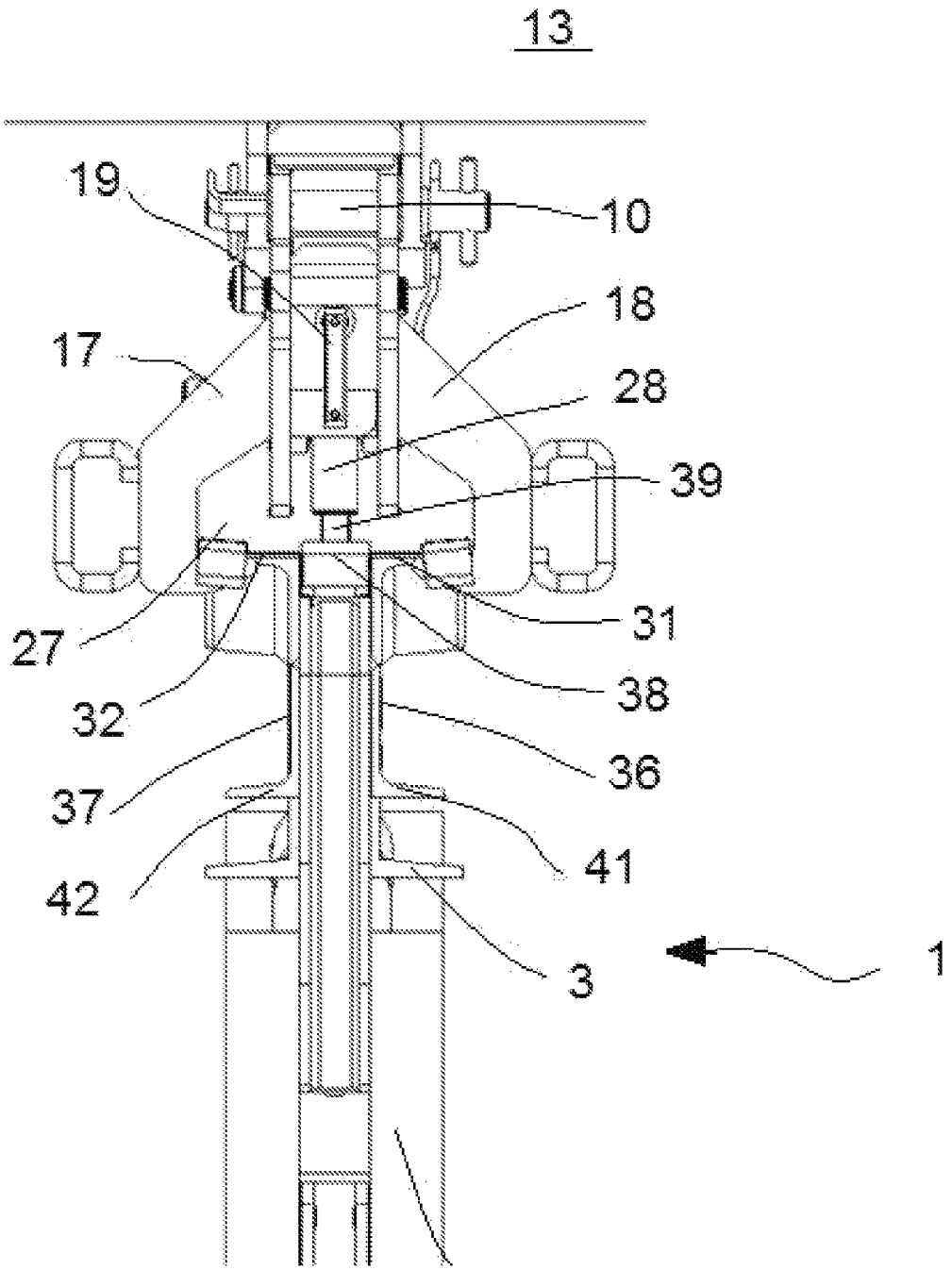
FIG. 9 shows a detailed top view of the self-climbing system in the position shown in FIG. 8.

Due to the weight of the main work platform 20 and of the auxiliary platforms 24 and 25, in the event that the self-climbing system 1 includes auxiliary platforms, the rails 3 tend to bend as they move in the climbing direction Z, being separated from the concrete sections 13, 14 and 15. In both cases, in order to thread the end of the rail 3 in the free shoe 10, i.e., in order for the flange of the rail 3 to go through the housing 27 of the shoe 10 in the climbing direction Z in a guided manner, the operator must straighten the rail 3 which requires excessive effort for the operator, sometimes being impossible since the end of the rail 3 is too far from the free shoe 10. To solve said problem, the self-climbing scaffold system 1 comprises a guide element 30 which is arranged directly or indirectly coupled to each rail 3 in a pivotable manner and is adapted for facilitating the threading of the rail 3 with the free shoe 10. FIGS. 3 to 6 show the different positions gradually adopted by the self-climbing system 1 until the rail 3 is completely threaded with the shoe 10. FIGS. 8 and 9 show another self-climbing system 1, wherein due to the weight of the platforms 20, 24 and 25, the rails 3 are considerably separated from the corresponding concrete section than in the case of the self-climbing system shown in FIGS. 3 to 6. FIGS. 2-6, 8 and 9 show the guide element 30 in a vertical orientation. FIG. 7 shows the guide element 30 in a horizontal orientation.

According to some implementations the guide element 30 comprises at least a first guide surface 31 and 32 which, in a prior position before the threading position, projects with respect to the rail 3 towards the anchor 4 of the free shoe 10. The first guide surface 31 and 32 is adapted for contacting with the free shoe 10 in the prior position and straightening the corresponding rail 3 with respect to the shoe 10 as said first guide surface 31 and 32 moves in a guided manner in the shoe 10 pivoting with respect to the rail 3.

Figure 10:
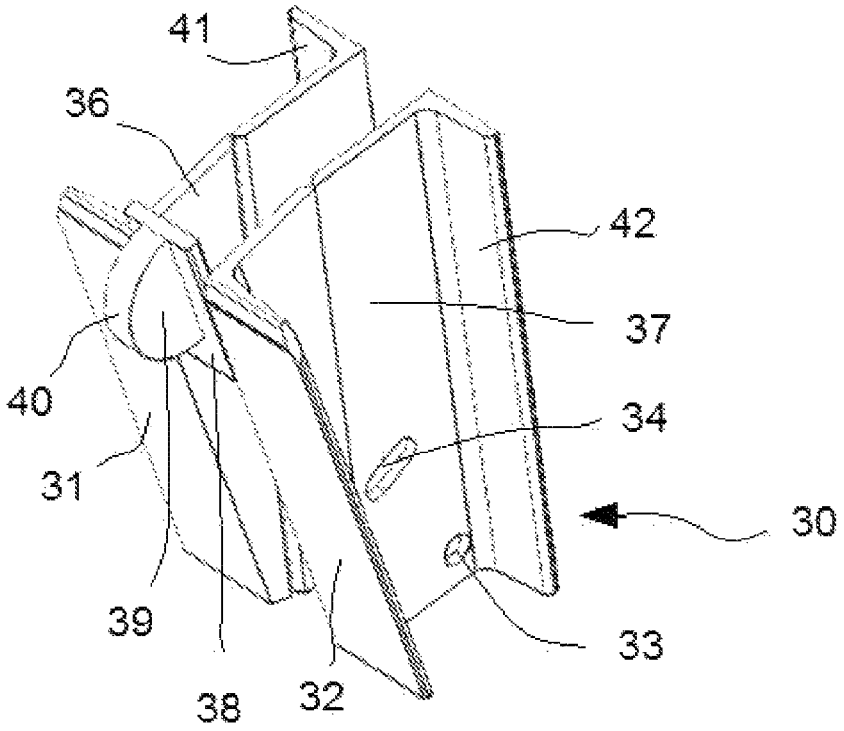
FIG. 10 shows a perspective view of the guide element of the self-climbing system shown in FIG. 1.
Figure 11:
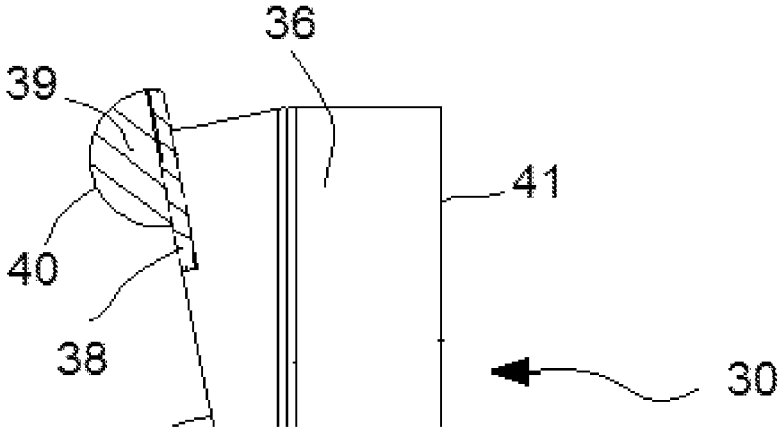
FIG. 11 shows a longitudinal section of the guide element shown in FIG. 8.

FIGS. 10 and 11 show one implementation of the guide element 30 in detail wherein which said guide element 30 comprises two sections 36 and 37 having a substantially C-shaped variable cross-section. Both sections 36 and 37 are attached to one another forming a section having a substantially H-shaped cross-section.

Sections 36 and 37 may be attached to one another through an attachment surface 38. Each section 36 and 37 has the first guide surface 31 and 32 corresponding with one of the flanges of the section 36 and 37, and a second guide surface 41 and 42 corresponding with the other flange of the corresponding section 36 and 37. In the implementations shown in the drawings, the attachment surface 38 attaches the second guide surfaces 41 and 42 to one another. Each second guide surface 41 and 42 is arranged facing the corresponding first guide surface 31 and 32.

Figure 4:
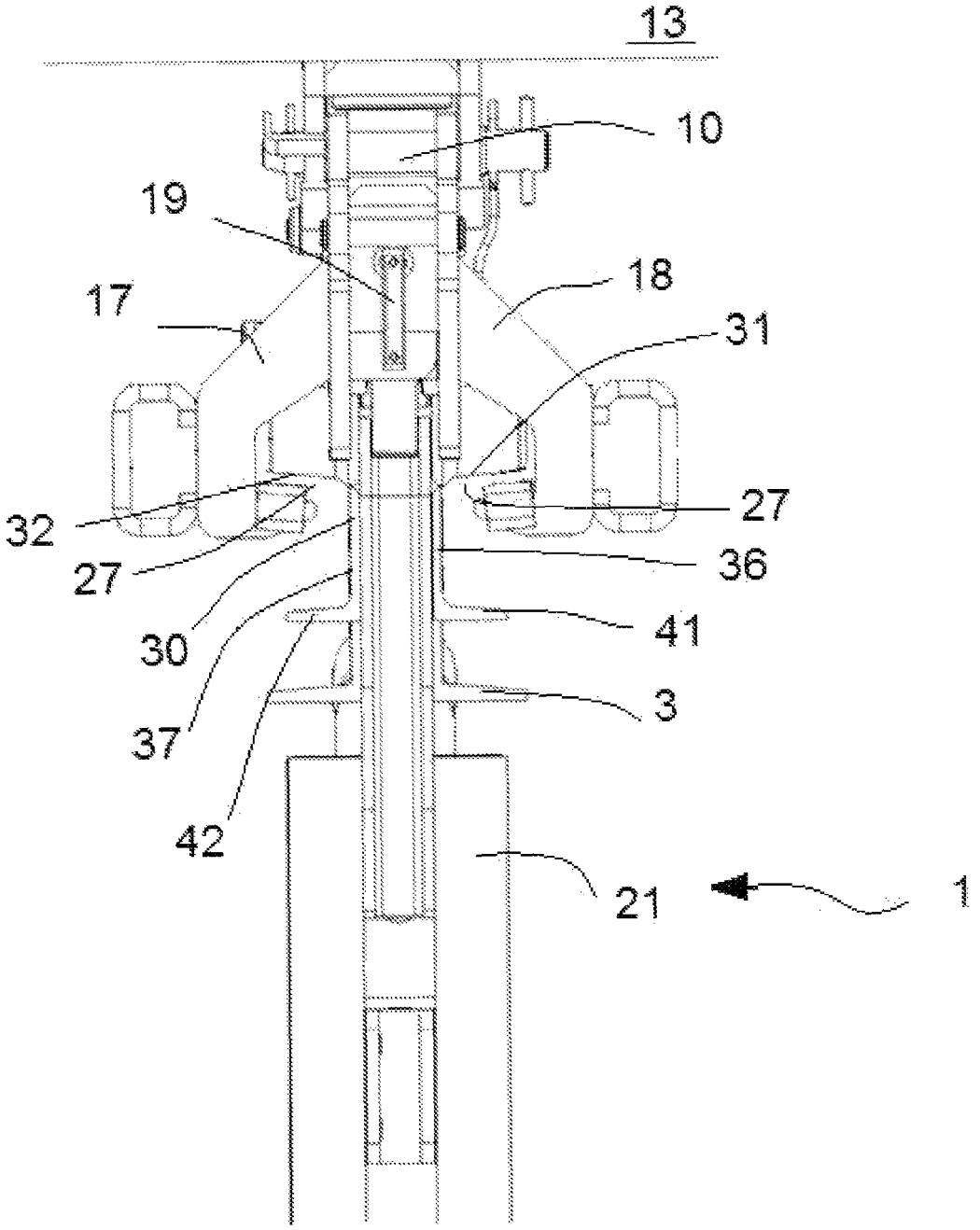
FIG. 4 shows a detailed top view of the self-climbing system in the position shown in FIG. 3.

FIGS. 4 and 9 show a threading of the guide element 30 in the shoe 10. In the closed claw position, the claws 17 and 18 brace the flanges corresponding to the first guide surfaces 31 and 32, guiding the movement of the guide element 30 with respect to the shoe 10 while at the same time pivoting with respect to the pivoting axis A1 and gradually straightening the rail 3 with respect to the shoe 10 to allow the final threading of the rail 3 with the shoe 10.

The guide element 30 may further comprise a projection 39 extending substantially orthogonal to the climbing direction Z from one end of the guide element 30. Said projection 39 has a geometry adapted for contacting with the rocker 28 of the free shoe 10. The projection 39 may comprise a curved surface 40 adapted for contacting with the rocker 28. Therefore, in addition to easing the contact of the guide element 30 with the free shoe 10, the guiding of the guide element 30 for threading in the shoe 10 is improved. Therefore, when the guide element 30 contacts with the free shoe 10, the curved surface 40 pushes the rocker 28, rotating it, both elements collaborating with one another after this point to thread the guide element 20 with the shoe 10.

The self-climbing system 1 comprises guide means 50 adapted for guiding the rotation of the guide element 30 with respect to the corresponding rail 3. The guide means 50 may comprise a curved slot 34 in the guide element 30 and a coupling 35 going through the curved slot 34 and through which the guide element 30 is arranged coupled to the rail 3. In the implementations shown in the drawings, the guide means 50 comprise a curved slot 34 in each section 36 and 37 and a coupling bolt 35 going through the guide element 30 and the connecting element 44.

Each first guide surface 31 and 32 may be an inclined surface. In the implementations shown in the drawings, each first guide surface 31 and 32 is a substantially planar surface extending at an angle with respect to the rail 3 towards the free shoe 10.

The guide element 30 comprises at one end a hole 33 through which the guide element 30 is coupled in a pivotable manner with respect to the rail 3. The guide element 30 is coupled to the connecting element 44 through a coupling 46 going through the hole 33 of the guide element 30 and a first hole 43 of the connecting element 44, coupling both elements 30 and 44 to one another in a pivotal manner.

Figure 3:
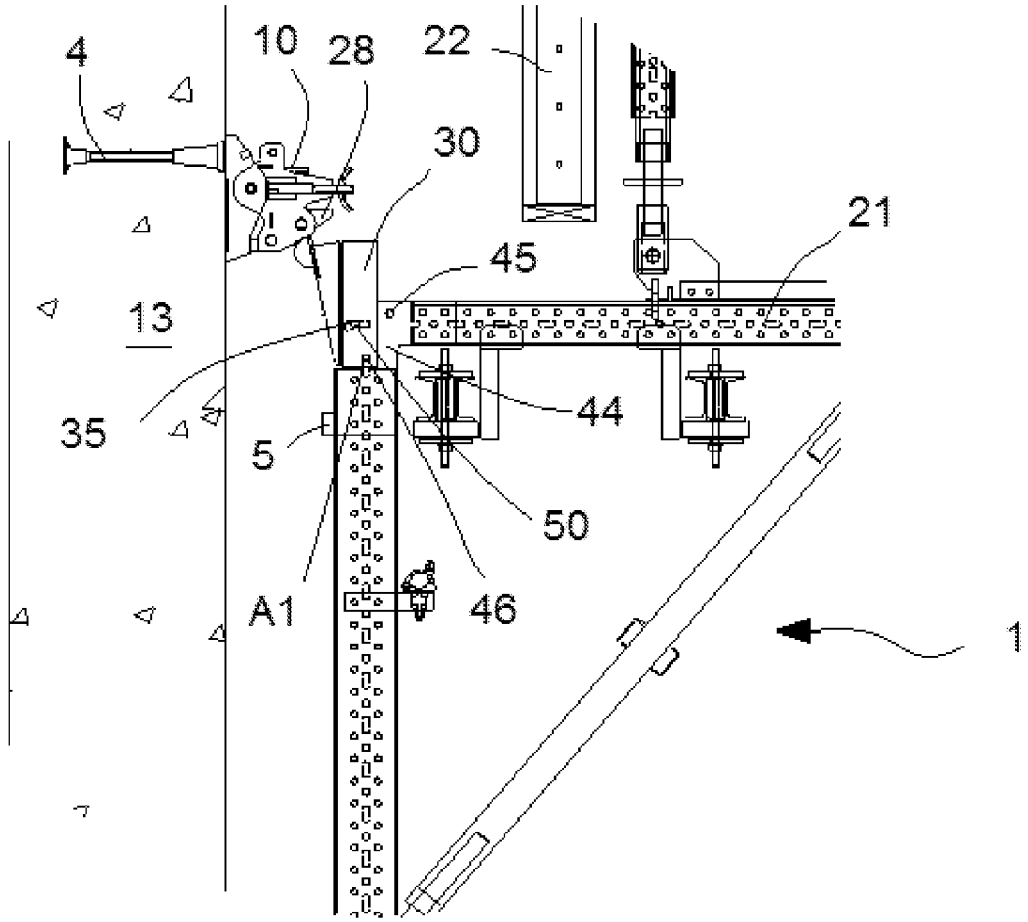
FIG. 3 shows a partial side view of the self-climbing system shown in FIG. 1 in a position prior to a threading position.
Figure 5:
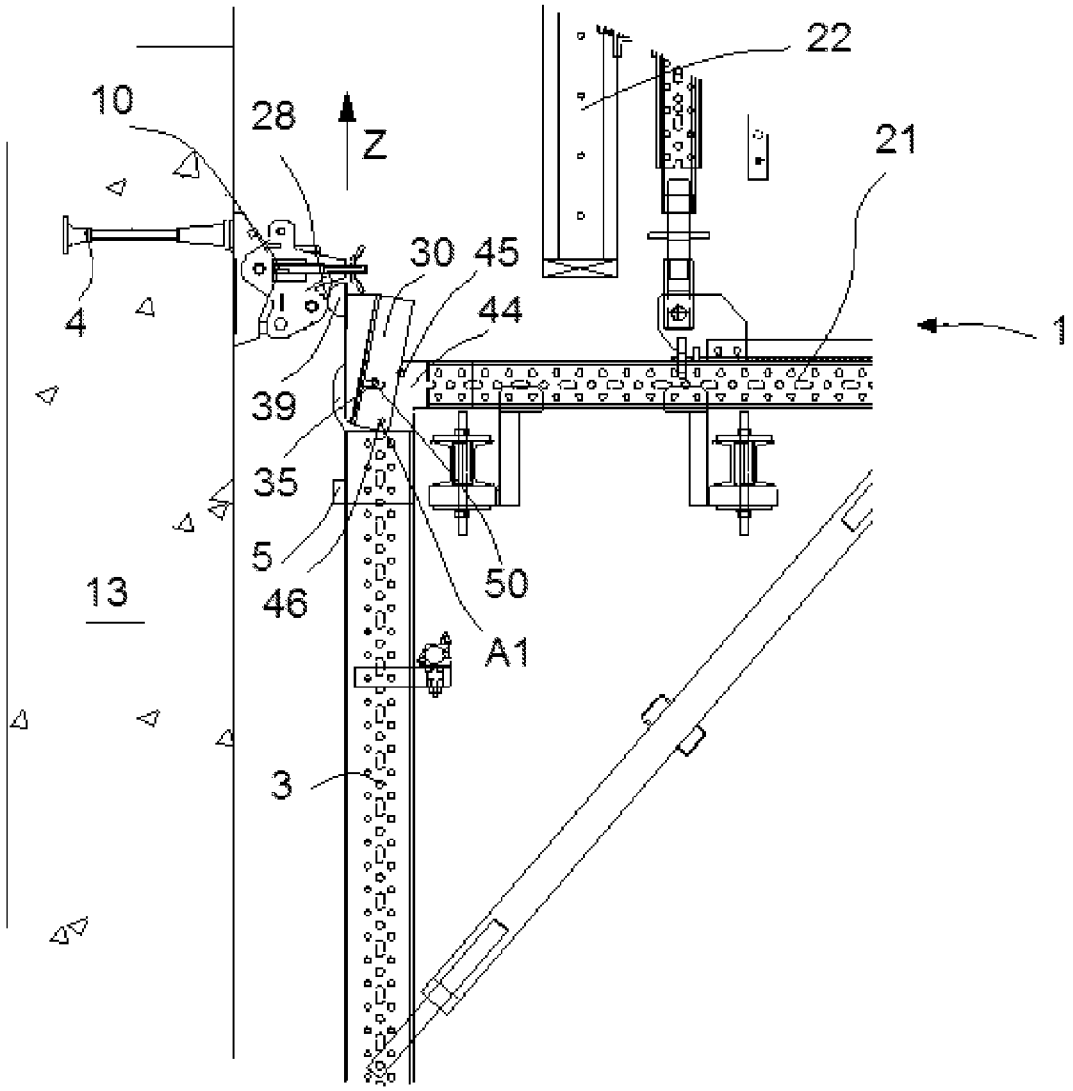
FIG. 5 shows a partial side view of the self-climbing system shown in FIG. 1 during threading.
Figure 6:
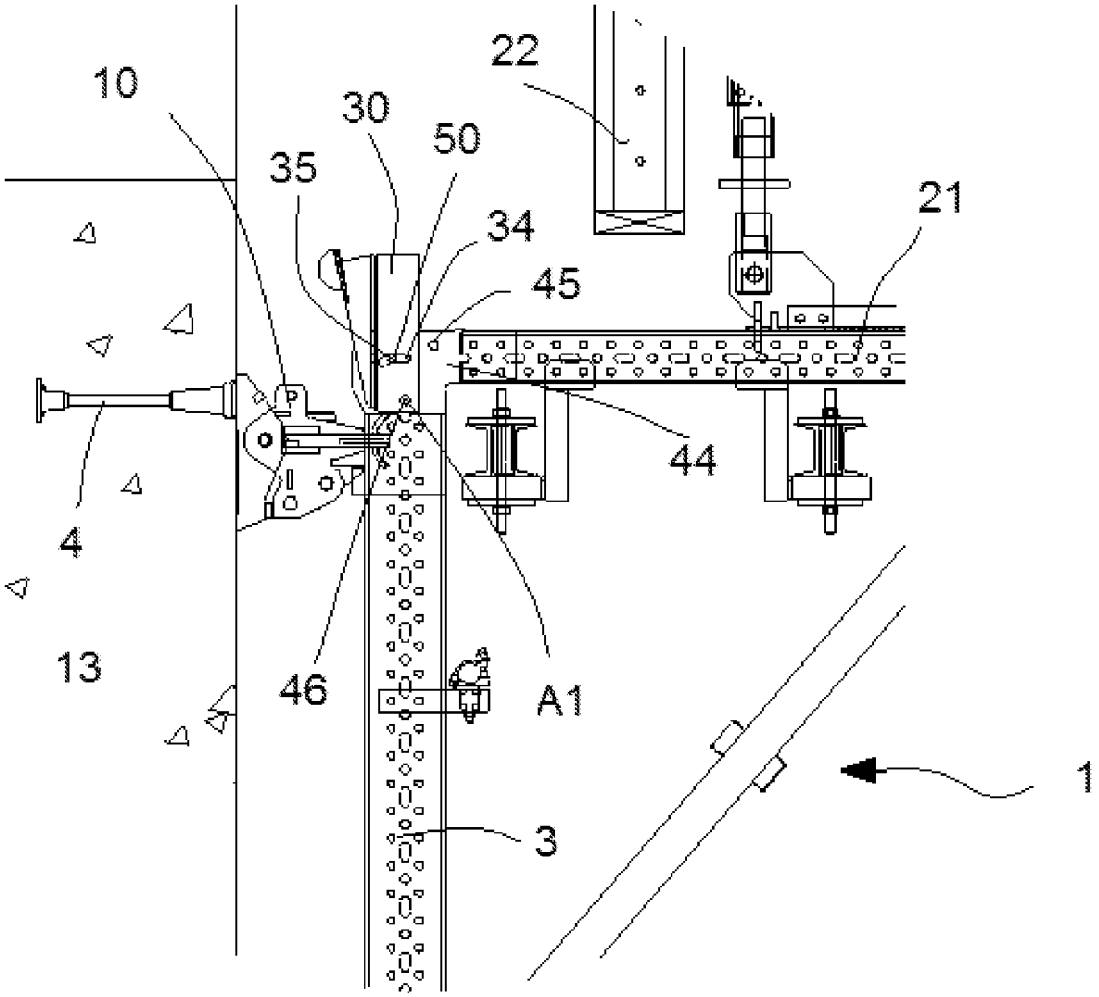
FIG. 6 shows a partial side view of the self-climbing system shown in a FIG. 1 once threaded.

In the prior position before the threading position for threading the rail 3 shown in FIGS. 3, 5 and 8, the axis of rotation A1 and the center of gravity of the guide element 30 are not in alignment; they are arranged such that the center of gravity is located between the respective concrete section and the axis of rotation A1. It is thus assured that the guide element 30 in the prior position before the threading position is arranged tilted towards the concrete sections, projecting with respect to the corresponding rail 3 towards the free shoe 10. In other implementations not shown in the drawings, the self-climbing system 1 can comprise means acting on the guide element 30, keeping it tilted towards the shoe 10, projecting with respect to the rail 3 in the prior position before threading, such that it allows contacting with the shoe 10.

In the working position shown in FIG. 7, the guide element 30 is arranged substantially in alignment with the guide 21 of the work platform 20 such that it allows the guided movement of the outer formwork 22 along the second guide surfaces 41 and 42 of the guide element 30. In the working position, the guide element 30 projects with respect to the rail 3 towards the corresponding concrete section 13, 14 and 15, thus increasing the length of the guide 21 through which the outer formwork 22 can move. In the working position, the guide element 30 is arranged coupled to the connecting element 44 through a second hole 45 with the coupling 46 going through the hole 33 of the guide element 30 and the second hole 45 of the connecting element 44, coupling both elements 30 and 44 to one another. The guide element 30 can rotate with respect to the guide means 50 to go from the working position to the threading position and vice versa. To that end, the coupling 46 to the connecting element 44 must have been previously removed. Any coupling 46 known in the state of the art can be used.

What is claimed is:

1. A self-climbing scaffold system comprising:

a rail having a lower section and an upper end;

a first shoe through which the lower section of the rail is threaded, the first shoe anchored to a first concrete section having a first facing wall, a second shoe anchored to a second concrete section having a second facing wall, the second concrete section being located vertically above the first concrete section; and a guide element coupled with the upper end of the rail and having a first flange section configured to be threaded through the second shoe, the first flange section having an outer guide surface facing the second facing wall that is configured to engage with at least a portion of the second shoe to vertically straighten the rail with respect to the second shoe when the first flange section is vertically threaded through the second shoe, the outer guide surface being rotatable towards and away from the second facing wall between first and second angular positions, the guide element comprising a hole that extends through the guide element, a first coupling element extending through the hole pivotally couples the guide element to a portion of the self-climbing scaffold system at a location at or near the upper end of the rail, the guide element including an elongate curved slot that extends through the guide element and that is spaced a distance away from the hole, the elongate curved slot cooperates with a second coupling element that extends through the elongate curved slot to delimit rotation of the outer surface of the guide element between the first and second angular positions; and a connecting element that connects the upper end of the rail to a horizontal guide, a major length of the horizontal guide arranged substantially orthogonal to a major length of the rail, the connecting element having a hole corresponding with the hole of the guide element, the guide element pivotally coupled to the connecting element by the first coupling element extending through the hole of the connecting element and the hole of the guide element, and the second coupling element extends from or through the connecting element.

2. The self-climbing scaffold system according to claim 1, wherein the first flange section of the guide element comprises an inner surface, the guide element further comprising a second flange section having an inner surface and an outer surface, the inner surface of the second flange section facing the inner surface of the first flange section, the outer surface of the second flange section being flat.

3. The self-climbing scaffold system according to claim 2 wherein the inner surface of the first flange section and the inner surface of the second flange section are not parallel to one another.

4. The self-climbing scaffold system according to claim 2, wherein the first and second flange sections form a part of a section of the guide element that has a substantially C-shaped cross-section.

5. The self-climbing scaffold system according to claim 1, wherein the guide element comprises a projection extending substantially orthogonal to the outer guide surface, the projection being configured to make contact with and rotate a rocker of the second shoe when the guide element is initially threaded through the second shoe.

6. The self-climbing scaffold system according to claim 5, wherein the projection comprises a curved surface.

7. The self-climbing scaffold system according to claim 1, wherein the outer guide surface is flat.

* * * * *